US006401314B1

(12) United States Patent
Spring et al.

(10) Patent No.: US 6,401,314 B1
(45) Date of Patent: Jun. 11, 2002

(54) METHOD AND A DEVICE FOR THREAD DIVISION ON A SECTIONAL WARPING MACHINE

(75) Inventors: Marcel Spring, Uzwil; Anton Spari, Niederhelfenschwil, both of (CH)

(73) Assignee: Benninger AG, Fabrikstrasse (CH)

( * ) Notice: Subject to any disclaimer, the term of this patent is extended or adjusted under 35 U.S.C. 154(b) by 0 days.

(21) Appl. No.: 09/797,604

(22) Filed: Mar. 5, 2001

(30) Foreign Application Priority Data

Jan. 31, 2001 (EP) ..... 01810094

(51) Int. Cl.[7] ..... D02H 9/00
(52) U.S. Cl. ..... 28/191; 28/198
(58) Field of Search ..... 28/190, 191, 192, 28/194, 195, 196, 198, 199, 202, 184, 208

(56) References Cited

U.S. PATENT DOCUMENTS 4,528,732 A * 7/1985 Lichtschlag ..... 28/181
4,893,386 A * 1/1990 Thier et al. ..... 28/184
5,022,128 A * 6/1991 Beerli et al. ..... 28/191
5,027,485 A * 7/1991 Hager et al. ..... 28/191
5,531,001 A * 7/1996 Beerli ..... 28/198
5,628,098 A * 5/1997 Beerli et al. ..... 28/191
5,940,945 A * 8/1999 Bommer et al. ..... 139/353

FOREIGN PATENT DOCUMENTS

DE 31 14 449 10/1982
DE 197 10 745 9/1998

* cited by examiner

*Primary Examiner*—Amy B. Vanatta
(74) *Attorney, Agent, or Firm*—Shoemaker and Mattare

(57) ABSTRACT

For inserting a dividing cord loop into the opened shed warp on a sectional warping machine, a dividing device has at its disposal an introduction element (28) with a first, preferably movable guide arm (26) and a second, preferably stationary guide arm (27). The free ends (29, 31) of the two guide arms may preferably be led together in a pincer-like movement. The guide arms are preferably designed as tubes which in the led-together condition form a flow channel. With the help of an air conveyor (35), from a bobbin chamber (28) a dividing cord may be drawn off and as a loop be layed around a divided shed warp lying between the two guide arms and by way of a knotting means be connected to a cord loop. The connected cord loop is thereafter by way of a suction device or a blower device positioned and tensioned in a manner such that the cord loop bears at least on one side on the divided shed warp or on the warp web.

22 Claims, 7 Drawing Sheets

Figure 1:
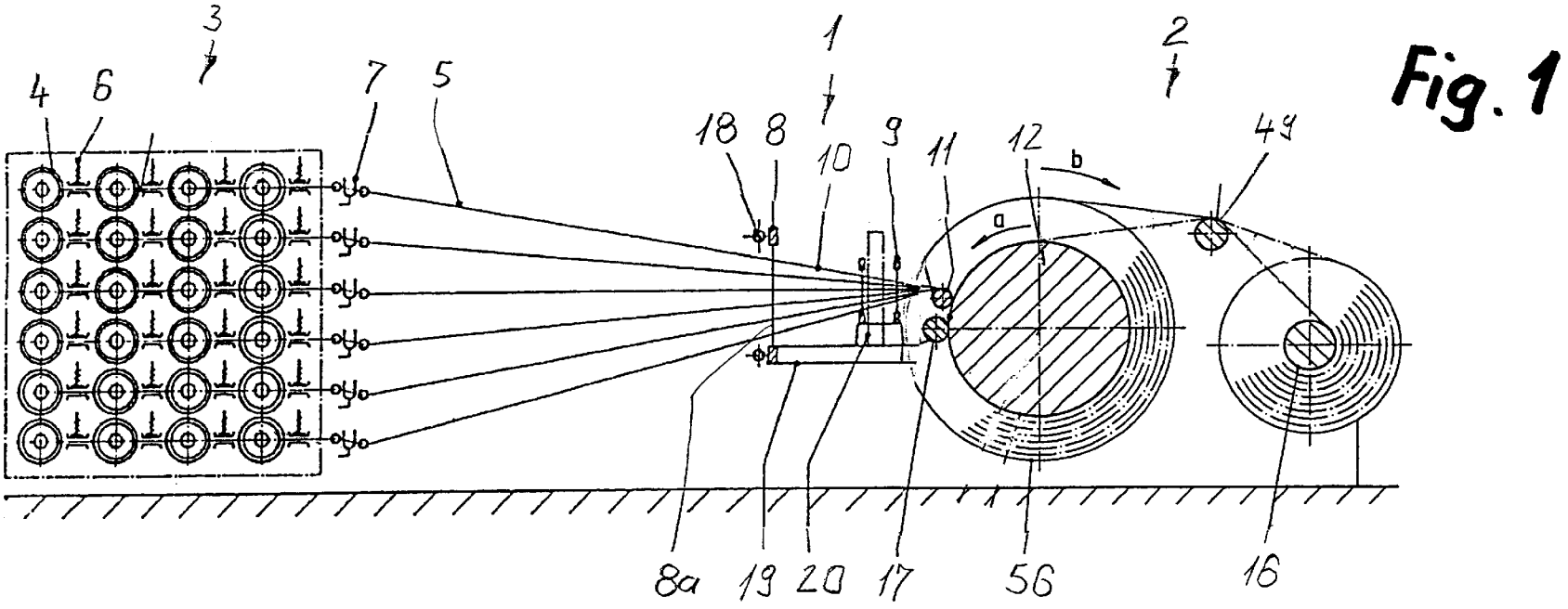

1
2
3
4
5
6
7
8
8a
9
10
11
12
16
17
18
19
20
49
56
a
b 14
12
15
48
11
13
59
23L
23g
58

METHOD AND A DEVICE FOR THREAD DIVISION ON A SECTIONAL WARPING MACHINE

The invention relates to a method and a device for thread division on a sectional warping machine, according to the preamble of claim 1 and claim 11 respectively. Such a method and such a device serve for separating individual groups of warp threads on winding onto the warping drum, in order to obtain a neat thread arrangement. The method is suitable for the automatic insertion of thread crossing and sizing dividing elements.

The insertion of a dividing cord originally carried out manually, for a long time has been carried out automatically. With this various methods and devices have become known.

EP A 368 801 describes a method with which two parallel individual sections via a dividing cord are introduced into the opened thread warp. Subsequently the sections on both sides of the divided shed warp are connected to one another. The simultaneous introduction of the individual sections is effected by two rod-like holding elements arranged at a distance to one another. The finished dividing element or the two individual sections are with this preferably formed by a plastic web which is weldable and does not need to be knotted. Such dividing elements are however not suitable for all application purposes.

DE A 44 43 627 describes a method with which a dividing cord is drawn in automatically with the help of a cord pull rod. For grasping the dividing cord this is suctioned through a suction tube. With this device however a dividing cord loop may not be layed around a shed warp in a single working procedure.

JP B 62-2055 describes a device which consists of two parallel thread tubes and which may be moved into an opened shed. In the completely moved-in position the two tube ends are connected to one another by a semicircular connection bow open on the inner side. The dividing cord by way of an airflow is introduced into the one thread tube, is turned round at the connection bow and in the neighbouring thread tube is led back again. The connection bow is rigidly arranged and because it is opened on the inner side the dividing cord may slide out with the traversing back of the two parallel thread tubes. A disadvantage however lies in the fact that the open connection bow causes a great pressure drop with the pneumatic conveying of the dividing cord. Furthermore the two thread tubes and the connection bow must always be exactly aligned to one another in order to guarantee a frictionless cord deflection.

By way of the narrow distance of the two thread tubes the thread crossing must be divided at a very steep angle. By way of this a clear dividing of the upper and lower thread position is not securely guaranteed.

On replacing the cord loops which are applied in webs on beaming through two through-going cords on account of the cord loops lying close next to one another the neat thread dividing is hardly possible with certain materials (hairiness).

A further disadvantage lies in the fact that the cord loops independently of the web width are always equally long. By way of this the cord loop is designed for the maximum web width. With smaller web widths the cord loop is much too long and is overwound by the next web. With beaming this has the result that the cord loops remain hanging and thread breakages arise.

It is therefore the object of the invention to provide a method of the above mentioned type with whose help a dividing cord in the simplest manner as a cord loop may be layed around a divided shed warp. The method is to be largely automisable with a low succeptibility to breakdown. The device should be simple to operate and it should also be suitable where appropriate for the retrofitting of existing sectional warping installations. Furthermore with various web widths there are to be able to be applied or manufactured dividing cord loops with always the same overlength.

This object according to the invention is achieved with a method which has the features of claim 1. With regard to the device the object is achieved by a device with the features of claim 11.

The leading together of the free ends of the two guide arms after the lateral introduction has the advantage that the dividing cord without supplementing auxiliary means may be directly transferred from one guide arm to the other guide arm. After the introduction of the dividing cord the free ends are again opened so far that a retraction of the introduction element is possible. With this with a further drawing-off of dividing cord, a cord loop is layed around the divided shed warp. The two guide arms function completely autonomously and a precise alignment to other components is not necessary.

The guide arms are advantageously tubes which on bringing together the two ends are connected into a through-going flow channel, wherein the dividing cord is drawn off by way of an airflow in the flow channel. Since the free tube ends are directly brought together there arises no pressure loss at the turning point of the dividing cord. The pressurised air consumption may therefore be kept relatively low. The air flow may for example be produced by applying a vacuum at, in relation to the flow direction, the output of the second guide arm. In certain cases the conveying of the dividing cord may however also be effected purely mechanically. With a sufficient stiffness it would also be conceivable to advance the dividing cord with the help of pinch rollers.

Since with a sectional warping process as a rule numerous dividing cord loops must be inserted, the method functions particularly rationally when an inserted cord loop of the introduction element is separated from the sections of the dividing cord still lying in the guide arms and when with the subsequent insertion procedure the dividing cord section lying in the second guide arm is led away together with the leading-back of a new dividing cord. Evidently the dividing cord remains, in this manner, need not be manually removed. That dividing cord section which remains in the first guide arm is already the beginning of the following dividing cord which with the next-following procedure is pneumatically transported into the second guide arm. The introduction element is advantageously moved on a linear advance path. Thus one may always insert to the suitable web width without carrying out an adaptation of the tube lengths.

After the retraction of the introduction element a knotting apparatus for knotting the cord loop is pushed into the region of the advance path, and after the knotting and separating off of the cord loop, is again retracted. In this manner also the knotting need not be carried out manually and the knotting apparatus may be placed exactly in the correct region without it impeding the introduction element. For this purpose it is particularly advantageous when the knotting apparatus on a flexible push element is displaced out of a rest position on a curved path into a knotting position. By way of this the knotting apparatus may be arranged in a space-saving manner below the advance plane of the introduction element.

Further advantages may be achieved when the knotted cord loop by way of a positioning and tensioning device is aligned in a manner such that the cord loop bears at least on one side on the divided shed warp or on the warp web. By way of this it is prevented that a laterally protruding cord loop is overwound by the next warp web. Thus on beaming it is prevented that the cord loops remain hanging and thread breakages arise. The alignment of the cord loops is effected advantageously contactless by way of a suction device or by way of a blowing device. Such a positioning and tensioning process could however also advantageously be applied with manual sectional warping machines for positioning and tensioning the cord loop.

It is furthermore advantageous when the cord loop is applied on the divided shed warp in a manner such that with the subsequent beaming process the cord loop lies on the outer side, i.e. above, which considerably simplifies the accessibility.

With the device according to the invention both guide arms are movably mounted in a manner such that their free ends are guidable together in a preferably pincer-like movement. With this it is advantageous when at least one of the two guide arms is pivotably mounted and when with a pressure means cylinder it may be moved to and from the neighbouring guide arm. For this a simple turning joint is sufficient, wherein only a relatively small pivoting angle must be covered in order the lead together the free ends. Alternatively the guide arms could however also be parallely led together or opened.

The two guide arms are preferably designed as tubes whose free ends after the bringing together form a closed hollow bow. Thus there arises a U-shaped flow channel in which unhindered a dividing cord may be advanced. The advance is effected with this with air conveyor apparatus (Air Mover) which for producing an air flow is in acting connection with the tubes. The first guide arm may with this at the entry be connected to a cord supply container and at the exit of the second guide arm there may be arranged an air conveyor apparatus for producing a vacuum in the tubes. Since the tubes together with the cord supply container form a closed channel system, the dividing cord may be drawn off in a simple manner and with a low energy expense.

The introduction element is advantageously mounted on a carriage, and along a linear advance path is introducable into the shed warp. In the region of the advance path there is a knotting apparatus displaceable preferably with the help of a flexible push element and along a curved path between a rest position and a knotting position.

Figure 7:
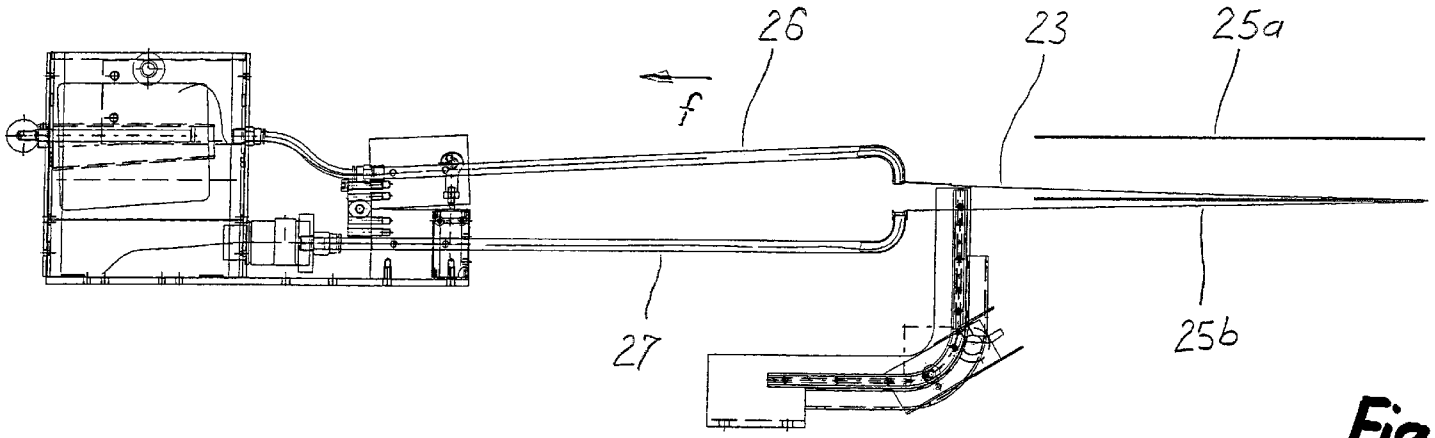
Figure 8:
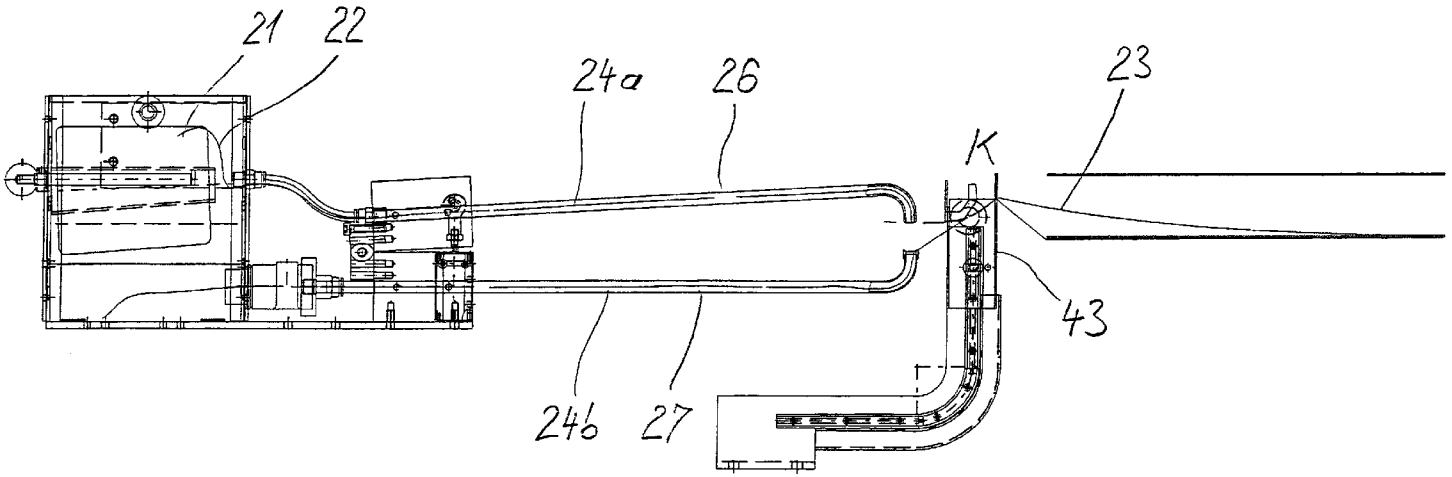
Figure 9:
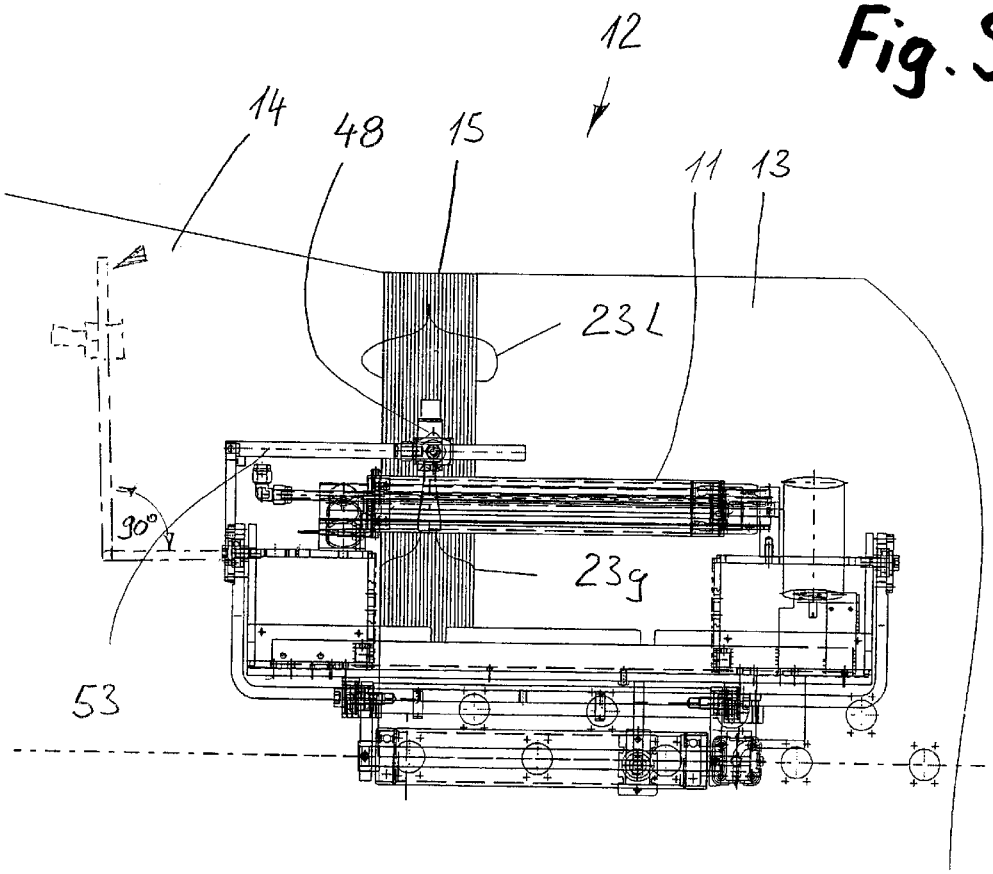
Figure 10:
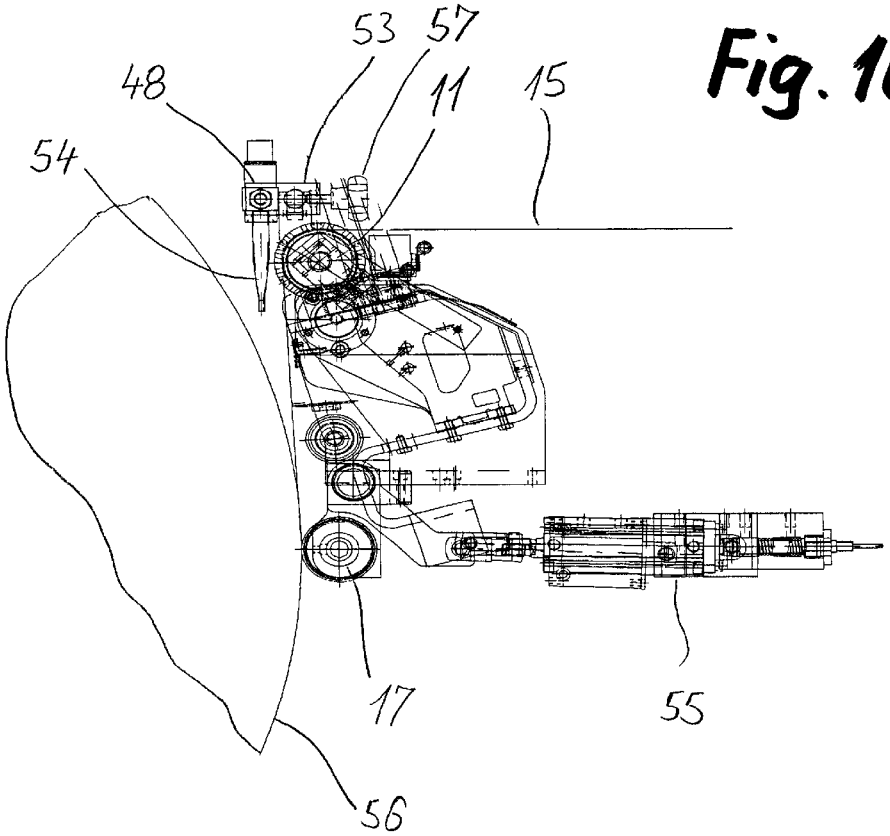

Further individual features and advantages of the invention result from the subsequently described embodiment example and from the drawings. There are shown in FIG. 1 a sectional warping installation in a lateral view schematically heavily simplified, FIG. 2 a divided thread sheet in a lateral view, FIG. 3 a part device with an introduction element and knotting device in a perspective representation, FIG. 4 the introduction element according to FIG. 3 after the moving into the shed warp with opened guide arms, FIG. 5 the introduction element after closing the guide arms for drawing in the dividing cord, FIG. 6 the introduction element after the re-opening of the guide arms with the dividing cord drawn in, FIG. 7 the introduction element after retraction from the shed warp with the cord loop, FIG. 8 the introduction element with the knotting device in the knotting position for knotting the cord loop, FIG. 9 a view in the thread running direction of the warping drum with a knotted cord loop, and thereafter by way of suctioning, with an aligned cord loop, FIG. 10 a lateral view of FIG. 9, and FIG. 11 a view in the thread running direction of the warping drum with a knotted cord loop, and thereafter by way of drawing off, with an aligned cord loop.

As is shown in FIG. 1 a sectional warping installation 1 consists essentially of the sectional warping machine and of the warp creel 3. On the warp creel there are stuck a plurality of bobbins 4 whose threads in each case pass a thread tensioner 6 which produces the desired thread tension. Subsequently each thread 5 passes a catch thread device 7 on which the presence control of the thread is carried out.

From the warp creel 3 the threads freely tensioned reach a lease 8 with the two lease reeds 8*a* in which the threads 5 obtain a certain thread arrangement, i.e. obtain position and sequence. Subsequently the threads are led through the reed 9 in which the threads are led together to the desired warp web width in order like this to be wound as a shed warp 10 via a deflection roller 11 in a manner known per se into a winding 56 on the warping drum 12.

Figure 2:
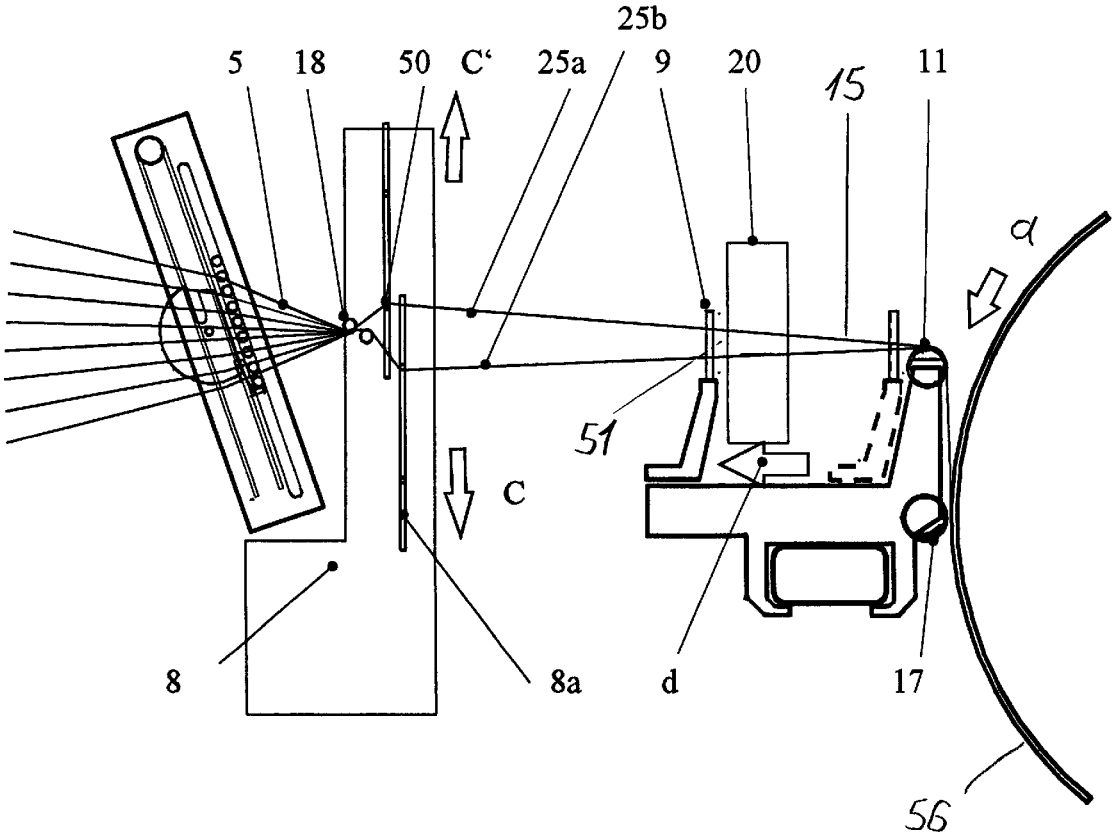

For shedding, the shed warp with the help of horizontal rods 18 is traversed together as will by yet explained by way of FIG. 2. The reed 9 as well as the actual dividing device 20 are arranged on a sectional warping table 19.

The warping drum rotates in the direction of arrow a so that the warp web is wound up around the deflection roller downwards. Below the deflection roller there is arranged a pressing roller 17 which presses the warp web with the required pressing force against the winding.

FIG. 1 shows also yet the warp beam 16 onto which after the sectional warping the totality of all warp webs are wound. The warping drum moves for beaming in the arrow direction b, wherein the warp in any case is yet also led over one or more deflection rollers 49.

For the shed formation, according to FIG. 2 firstly all threads 5 coming from the warp creel 3 by way of traversing together the two rods 18 are led together onto a horizontal plane. Subsequently the two lease reeds 8*a* are moved in the direction c and c'. The one lease reed is moved downwards in the arrow direction c and the other upwards in the arrow direction c'. By way of the suitable arrangement of the soldering locations 50 there arises a clean symmetrical shed with an upper divided shed warp 25*a* and a lower divided shed warp 25*b*.

In this manner a shed is opened 59 into which a dividing loop may be inserted.

Since the inserted loop may not pass the reed 9 the insertion of the dividing cord seen in the thread running direction must be effected after the reed. For this purpose the reed must be displaced from its normal operating position in the arrow direction d towards the lease reeds 8*a*. Now the symbolically shown dividing device 20 may be activated in order to introduce the dividing cord into the open shed or to delimit the lower divided shed warp 25*b* with a cord loop.

Figure 3:
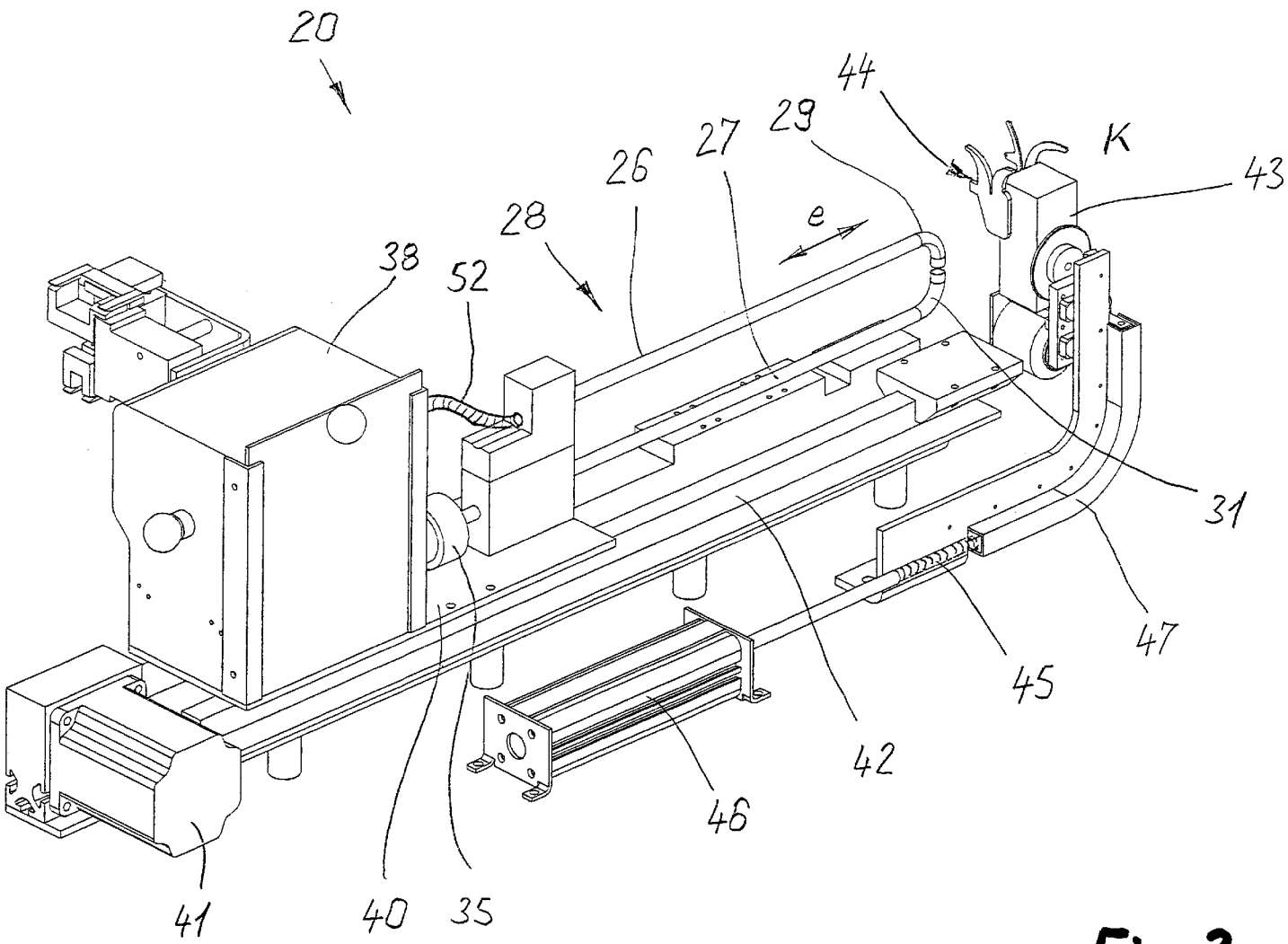

FIG. 3 shows the dividing device indicated in its entirety at 20, whose essential working element consists of the introduction element 28 and the knotting device 43. The introduction element is arranged on a carriage 40 which in the arrow direction e is linearly displaceable on a rail 42. The drive is effected by a positionable drive system 41 so that always one may insert by the suitable web width and the dividing cord may be manufactured exactly onto the web width. Preferably the drive system consists of a linear unit with a drive motor, but may also be effected by a pneumatic linear unit or other drive systems.

The introduction element has at its disposal a first upper guide arm 26 and a second lower guide arm 27 in the form Of tubes whose free ends 29 and 31 are bent by 90° in a circular-arc-shaped manner.

Figure 4:
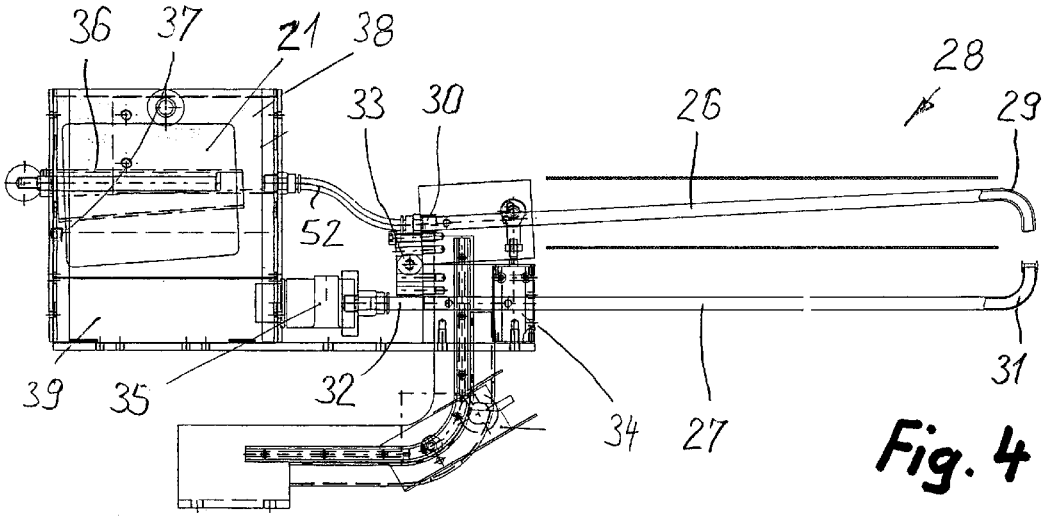
Figure 5:
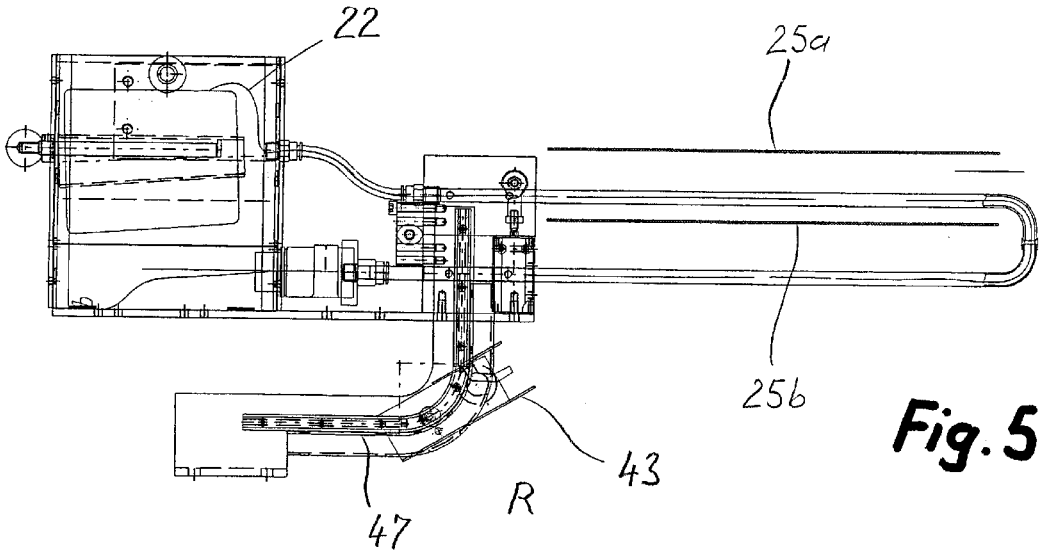

Further details of the introduction element are evident from FIG. 4. The first upper guide arm 26 is mounted on a joint 33 so that it is pivotable from a closure position parallel to the second lower guide arm 27 into an opening position. The opening movement is effected with this with the help of a pneumatic cylinder 34. Preferably the first upper guide arm 26 by way of a spring is biased into the closure position so that one may operate with a pressure means cylinder impingable on one side.

At the inlet 30 of the first upper guide arm 26 there is connected a flexible connection tubing 52 which leads to a bobbin chamber 38. In the bobbin chamber on a bobbin mounting 36 there is held a dividing cord bobbin 21 from which a dividing cord 22 (FIG. 5) may be drawn off. In the region of the bobbin mounting 36 there is arranged a photo-sensor 37 which monitors the dividing cord supply. Below the bobbin chamber 38 separately divided off there is arranged a chamber 39 which receives the dividing cord remains from the second lower guide arm 27.

For the conveying of the dividing cord at the outlet 32 of the second guide arm 27 there is arranged an air conveyor 35 which in the tube conduit produces a vacuum which is sufficient in order to convey the dividing cord.

From FIG. 3 it is further evident that below the rail 42 there is arranged a bent guide channel 47 which extends roughly at a right angle up to the plane of the rail. In this guide channel a flexible push element 45 may be moved with the help of a drive 46, e.g. in the form of a pressure means cylinder. On the flexible push element there is fastened a knotting apparatus 43 known per se with a cutting device 44. The knotting apparatus may in this manner be displaced from a rest position R below the movement plane of the introduction element 28 (FIG. 5) into a knotting position K on the advance plane of the introduction element (FIG. 3).

For inserting the dividing cord loop proceeding from the opened shed according to FIG. 2 the following procedure takes place:

Firstly the dividing device travels in the direction of the lease reeds 8*a* and then guides a dividing rod not shown in detail here, in the region of the largest possible shed opening, into the shed 51. In order to ensure that the divided shed warps 25*a* and 25*b* are divided cleanly from one another the dividing device then moves in the direction of the warping drum into the actual working position. Here the introduction element 28 according to FIG. 4 is introduced into the shed warp so that the first upper guide arm 26 in the open shed lies between the divided shed warps 25*a* and 25*b*. With easily dividing materials after the shed formation by way of the lease the additional dividing procedure by way of the part rod may be done away with.

After reaching this position the first upper guide arm 26 is pressed against the free end 31 of the second lower guide arm 27. As is evident from FIG. 5 the two guide arms run with this parallel to one another. In this position the air conveyor 35 is activated, wherein the dividing cord 22 is drawn off and led through the first upper and second lower guide arm. Shortly after the actuation of the air conveyor 35 the first upper guide arm 26 must be opened so that the cord beginning and the cord remains may be suctioned into the second lower guide arm 27. A cord remains previously remaining in the second lower guide arm 27 is with this simultaneously conveyed into the chamber 39.

Figure 6:
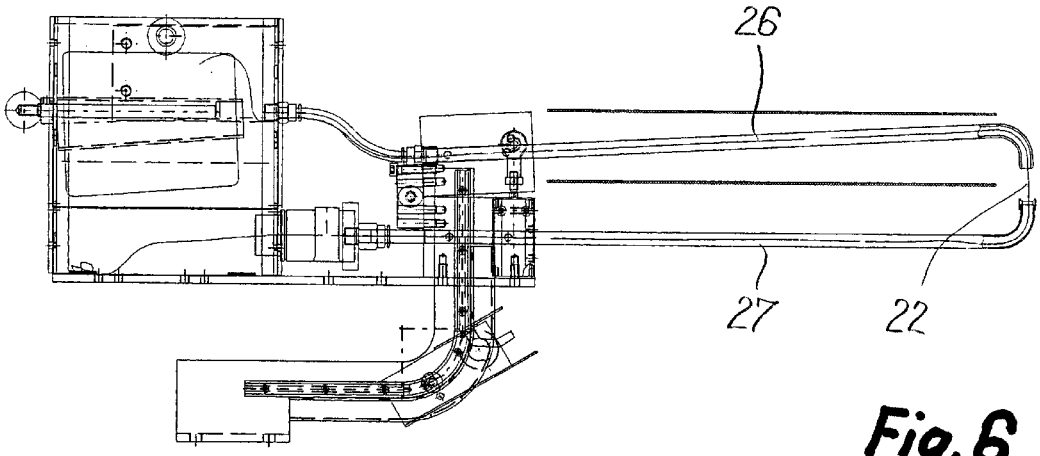

After opening the first upper guide arm 26 the dividing cord 22 is tensioned between the two free ends 29 and 31. This situation is shown in FIG. 6. In order to lay a dividing cord loop 23 around the lower divided shed warp 25*b* now the introduction clement 28 according to FIG. 7 must be pulled back in the arrow direction f. With this return movement again some dividing cord is wound off from the bobbin. Subsequently the dividing cord loop 23 may be knotted. For this purpose according to FIG. 8 the knotting apparatus 43 is pushed into the knotting position K. The knotted cord loop is with this simultaneously separated off with the cutting device so that in the two guide arms in each case there remains a dividing cord section 24*a* and 24*b*. The section 24*a* with this forms the beginning of the next following dividing cord inlay whilst the section 24*b* is removed together with the next cord draw-in.

Of course in exactly the same manner one may also lay a cord loop around the upper divided shed warp 25*a*. The two guide arms 26, 27 with this do not necessarily need to be arranged on a vertical plane. In certain cases it would even be conceivable on both sides of a thread crossing point to simultaneously insert a cord, wherein the two guide arms must lie on a horizontal plane. Preferably the dividing cord is applied on that divided shed warp which with the winding-up lies on the side distant to the drum. By way of this the cord on beaming is better accessible and thread breakages on unbeaming may be avoided. With the embodiment example this is the lower divided shed warp 25*b*. The device according to the invention may be applied with fully automatic sectional warping machines as well as also with manual machines.

FIG. 9 and 10 again show an auxiliary device which may also be applied with the processing of conventional dividing cord loops. The warping drum 12 has a cylindrical part 13 and a conical part 14. The warp web 15 is with this wound up along the cone incline in order to achieve an optimal winding stability. Directly after the formation of the dividing cord loop this encompasses as a loose dividing cord loop 231 the warp web in a manner such that the loop projects beyond the warp web on both sides. This has the result that the projecting loop section is overwound by the next following warp web and on unbeaming may lead to thread breakages. The dividing cord loop must therefore be arranged as a positioned and tensioned dividing cord loop 23*g* in a manner such that the loose loop end lies completely within the width of the warp web.

For this purpose on an extension arm 53 there is arranged a suction apparatus (ejector) 48 which serves as a positioning and tensioning device. The extension arm is thus arranged as close as possible on the warp drum in front of the wind-up point. The firsly loose dividing cord loop 231 is, shortly before the overwinding by the warp web, suctioned through the ejector with a suction nozzle 54, wherein the loose loop section from the edge zones is positioned into the middle of the web warp. At the position 55 there is represented a pressure means cylinder with which the pressing roller 17 is pressable against the winding 56. The suction nozzle 54 is adjustable with respect to its relative angular position, insertion depth into the spandrel between the winding and the warp web, as well as the distance to the deflection roller. The whole extension arm 53 may preferably be pivoted out by about 90° (FIG. 9) in order to simplify the access to the warp web. The ejector is via a conduit not shown here supplied with pressurised air (for producing a suction effect). The fastening on the extension arm 53 may be effected via a fastening screw 57.

Figure 11:
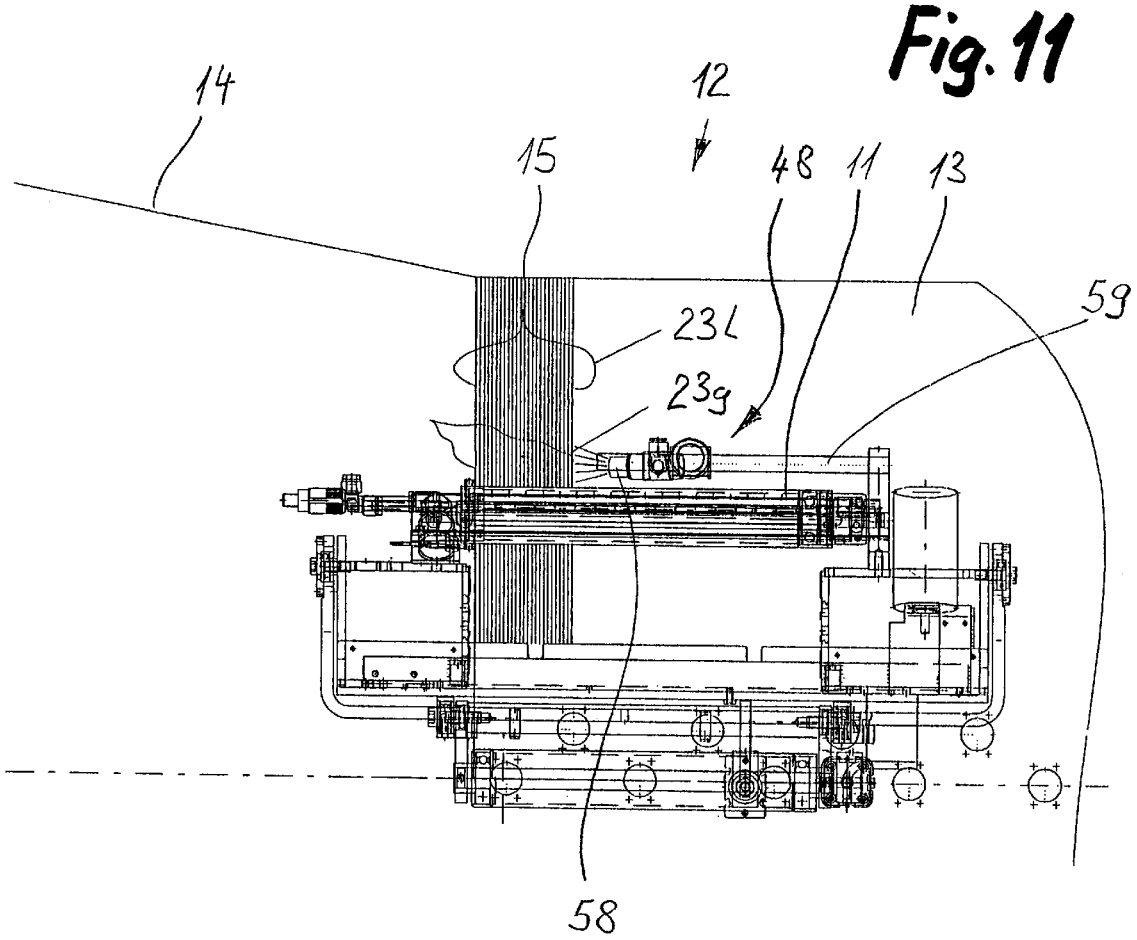

An alternative embodiment form of a positioning and tensioning device is shown in FIG. 11. An influencing of the loose cord loop 231 is evidently not only possible by suctioning but also by blowing. For this purpose via an adjustable blowing nozzle 58 the cord loop is blown from that side on which the subsequent warp web is to be wound. The cord loop 23*g* with this tensions in the direction of the cone part 14 by which means it in the picture bears at least on the right side on the warp web 15.

The blowing nozzle 58 is likewise fastened on an extension arm 59 and via a suitable supply conduit is supplied with pressurised air.

What is claimed is:

1. A method for thread division on a sectional warping machine (2), with which between the threads (5) of a shed warp (10) which are opened for shed formation there is inserted a dividing cord (22) for delimiting a divided shed warp **(25*a*, 25*b*), wherein firstly an introduction element (28) consisting of a first and a second guide arm (26, 27) is laterally introduced into the shed warp, subsequently from a dividing cord supply a dividing cord is drawn off and by way of the introduction element, as a cord loop (23) embracing the divided shed warp, is applied into the shed warp in a manner such that the dividing cord is introduced along the first guide arm (26), turned and led back along the second guide arm (27), and wherein lastly the introduction element is retracted out of the shed warp and the cord loop is knotted, wherein the free ends (29, 31) of the two guide arms (26, 27) after the lateral introduction are brought together, wherein the dividing cord at the ends is directly transferred from the first guide arm to the second guide arm and the free ends for retracting the introduction element (28)** are again opened.

2. A method according to claim 1, wherein the guide arms (26, 27) are tubes which on bringing together the free ends are connected into a through-going flow channel and that the dividing cord (22) by way of an airflow in the flow channel is drawn off.

3. A method according to claim 2, wherein the airflow is produced by applying a vacuum at the second guide arm (27).

4. A method according to claim 2, wherein the inserted cord loop (23) after the retraction of the introduction element (28) is separated from the sections **(24*a*, 24*b*) of the dividing cord still lying in the guide arms and that with the next following insertion procedure the dividing cord section (24*b*) lying in the second guide arm (27)** is led away together with the leading-back of a new dividing cord.

5. A method according to claim 1, wherein the introduction element (28) is moved on an advance path, and that after the retraction of the introduction element a knotting apparatus (43) for knotting the cord loop (23) is pushed into the region of the advance path, which after the knotting and separating off of the cord loop is again retracted.

6. A method according to claim 5, wherein the knotting apparatus (43) on a flexible push element (45) is displaced from a rest position on a curved path into a knotting position.

7. A method according to claim 1, wherein the knotted cord loop (23) by way of a positioning and tensioning device (48) is positioned and tensioned in a manner such that the cord loop at least on one side bears on the embraced divided shed warp or on the warp web (15).

8. A method according to claim 7, wherein the cord loop (23) is suctioned with a suction device and in this manner is positioned and tensioned.

9. A method according to claim 7, wherein the cord loop (23) is blown with a blower device (58) and in this manner is positioned and tensioned.

10. A method according to claim 1, wherein the cord loop (23) is applied on the divided shed warp **(25*b*)** in a manner such that with a subsequent beaming procedure the cord loop lies on the outer side.

11. The method of claim 1, wherein the free ends of the guide arms are brought together in a pincer-like movement.

12. A device for the thread division on a sectional warping machine (2), with an introduction element (28) consisting of a first and of a second guide arm (26, 27), which is introducable laterally into the threads (5) of a shed warp (10) opened for shed formation, wherein by way of an advance device (35) a dividing cord (22) is introducable along the first guide arm (36), turned and may be led back along the second guide arm (27), in a manner such that there is formed a cord loop (23) embracing a divided shed warp **(25*b*), wherein the two guide arms (26, 27) are movably mounted in a manner such that their free ends (29, 31)** may be led together.

13. A device according to claim 12, wherein at least one of the two guide arms (26) is pivotably mounted and that the arm with a pressure means cylinder (34) is movable towards and away from the neighbouring guide arm (27).

14. A device according to claim 12, wherein the two guide arms (26, 27) are designed as tubes whose free ends (29, 31) after bringing together form a closed tube bow.

15. A device according to claim 14, wherein the advance device is an air conveying apparatus (35) which for producing an airflow is in active connection with the tubes.

16. A device according to claim 15, wherein the first guide arm (26) at an entrance (30) is connected to a cord supply container (38) and that on the second guide arm (27) there is arranged an air conveying apparatus (35) for producing a vacuum in the tubes.

17. A device according to claim 12, wherein the introduction element (28) is mounted on a carriage (40) and along an advance path (42) is introducable into the shed warp, and that in the region of the advance path a knotting apparatus (43) is displaceably mounted in a manner such that it is movable from a rest position given a moved-in introduction element into a knotting position given a retracted introduction element.

18. A device according to claim 17, wherein the knotting apparatus (43) is fastened on a flexible push element (45) and is movable along a curved path (47) between the rest position and the knotting position.

19. A device according to claim 12, wherein the dividing cord may be drawn-off from a cord bobbin mounting (36) which is arranged in the active region of a photo-sensor (37) for monitoring the cord supply.

20. A device according to claim 12, wherein in the region of a winding-up point of the shed warp onto a warping drum, there is arranged a positioning and tensioning device (48) with which a knotted cord loop (23) is positionable and tensionable.

21. A device according to claim 20, wherein the positioning and tensioning device (48) comprises a suction device or a blowing device.

22. The device of claim 11, wherein the free ends of the guide arms are led together in a pincer-like movement.

* * * * *

UNITED STATES PATENT AND TRADEMARK OFFICE

CERTIFICATE OF CORRECTION

PATENT NO. : 6,401,314 B1
DATED : June 11, 2002
INVENTOR(S) : Spring et al.

It is certified that error appears in the above-identified patent and that said Letters Patent is hereby corrected as shown below:

Title page,
Item [30], should read as follows:
-- Foreign Application Priority Data
Apr. 4, 2000 (EP) ..... 00107340
Jan. 31, 2001 (EP) ..... 01810094 --

Signed and Sealed this

Twenty-second Day of October, 2002

*Attest:*

*Attesting Officer*

JAMES E. ROGAN
*Director of the United States Patent and Trademark Office*